US008286819B1

(12) United States Patent
Morris, Jr.

(10) Patent No.: US 8,286,819 B1
(45) Date of Patent: Oct. 16, 2012

(54) PAIL WITH LOCKING LID

(76) Inventor: Glenn H. Morris, Jr., Chattanooga, TN (US)

( * ) Notice: Subject to any disclaimer, the term of this patent is extended or adjusted under 35 U.S.C. 154(b) by 247 days.

(21) Appl. No.: 12/778,221

(22) Filed: May 12, 2010

(51) Int. Cl.
*B65D 45/22* (2006.01)

(52) U.S. Cl. ..... 220/326; 220/302; 220/328

(58) Field of Classification Search ..... 220/302, 220/326, 328; 215/330, 220, 216
See application file for complete search history.

(56) References Cited

U.S. PATENT DOCUMENTS

| | | | |
|---|---|---|---|
| 1,232,741 | A | 7/1917 | West |
| 1,498,416 | A | 6/1921 | Willett |
| 2,084,568 | A | 6/1935 | White |
| 2,459,668 | A | 5/1944 | Melichar |
| 2,445,802 | A | 1/1945 | Robinson |
| 2,906,429 | A | 7/1955 | Marchyn |
| 2,866,574 | A | 1/1957 | Roumeliotis |
| 2,893,590 | A | 7/1957 | Buckley |
| 2,907,492 | A | 2/1958 | Robertson |
| 3,058,527 | A | 10/1962 | Dennis et al. |
| 3,127,049 | A | 3/1964 | Welty et al. |
| 3,128,005 | A | 4/1964 | Sherlock |
| 3,181,718 | A | 5/1965 | Chancellor |
| 3,311,253 | A | 3/1967 | Pechacek |
| 3,376,992 | A | 4/1968 | Klapp, Sr. |
| 3,458,079 | A | 7/1969 | Gasbarra |
| 3,514,003 | A | 5/1970 | Fitzgerald |
| 3,612,323 | A | 10/1971 | Malick |
| 3,648,876 | A | 3/1972 | Berman |
| 3,744,655 | A | 7/1973 | Nixdorff, Jr. |
| 3,844,438 | A | 10/1974 | St. Pierre et al. |
| 3,902,620 | A | 9/1975 | McIntosh |
| 3,942,679 | A | 3/1976 | Starr |
| 3,963,139 | A * | 6/1976 | Gach ..... 215/216 |
| 3,977,563 | A | 8/1976 | Holt |
| 4,053,077 | A | 10/1977 | DeFelice |
| 4,063,639 | A | 12/1977 | Grant |
| 4,154,354 | A | 5/1979 | Ryder |
| 4,198,040 | A | 4/1980 | Colasent |
| 4,244,920 | A | 1/1981 | Manschot et al. |
| 4,245,753 | A | 1/1981 | Ellis |
| 4,288,000 | A | 9/1981 | Luker et al. |
| 4,293,080 | A | 10/1981 | Letica |
| 4,308,970 | A | 1/1982 | Von Holdt |
| 4,347,947 | A | 9/1982 | Hammes |
| 4,434,910 | A | 3/1984 | Groult |
| 4,453,647 | A | 6/1984 | Neat |
| 4,491,238 | A | 1/1985 | Tobolt |
| 4,494,674 | A | 1/1985 | Roof |
| 4,512,484 | A | 4/1985 | Mar |
| 4,732,288 | A | 3/1988 | Morris, Sr. |
| 4,819,824 | A | 4/1989 | Longbottom et al. |
| 4,967,926 | A | 11/1990 | Morris, Sr. |
| 4,978,004 | A | 12/1990 | Silverstein et al. |
| 4,989,739 | A | 2/1991 | Falcone et al. |
| 5,027,954 | A | 7/1991 | Hickerson |

(Continued)

*Primary Examiner* — Stephen Castellano
(74) *Attorney, Agent, or Firm* — Stephen J. Stark; Miller & Martin PLLC

(57) ABSTRACT

An open ended container with locking lid can provide a number of features. The lid and the container have cooperating threads. The lid has also has a locking mechanism connected to the lid, such as from a downwardly extending wall. The container has a stop, in some embodiments accessible from below, such as with an upwardly extending abutment of the locking mechanism. In fact, some embodiments have a stop as a portion of teeth in which at least some of the teeth which are not in contact with an abutment of the locking mechanism, engage the threads of the lid to assist in retaining the lid on the container.

19 Claims, 1 Drawing Sheet

U.S. PATENT DOCUMENTS

| | | | |
|---|---|---|---|
| 5,052,576 | A | 10/1991 | Budenbender |
| 5,058,754 | A | 10/1991 | Hickerson |
| 5,125,538 | A | 6/1992 | Morris, Sr. |
| 5,147,060 | A | 9/1992 | Lima et al. |
| 5,167,344 | A | 12/1992 | Van Schilt |
| 5,190,181 | A | 3/1993 | Budenbender |
| 5,224,615 | A | 7/1993 | Hickerson |
| 5,295,601 | A | 3/1994 | Bostelman |
| 5,328,047 | A | 7/1994 | Smith |
| 5,377,858 | A | 1/1995 | Morris, Sr. |
| 5,452,748 | A | 9/1995 | Simmons et al. |
| 5,503,187 | A | 4/1996 | Simmons et al. |
| 5,520,296 | A | 5/1996 | Freed |
| 5,544,768 | A | 8/1996 | Gargione |
| 5,664,693 | A | 9/1997 | Krall |
| 5,735,427 | A | 4/1998 | Hunter et al. |
| 5,785,203 | A | 7/1998 | Arshinoff et al. |
| 5,788,098 | A | 8/1998 | Mader |
| 5,816,422 | A | 10/1998 | Roig |
| 5,915,575 | A | 6/1999 | Morris, Sr. |
| 5,941,402 | A | 8/1999 | Krueger |
| 5,944,214 | A | 8/1999 | Conti |
| 5,947,462 | A | 9/1999 | Roussel |
| 6,006,942 | A | 12/1999 | Morris, Sr. et al. |
| 6,032,817 | A | 3/2000 | Ejima et al. |
| 6,039,196 | A | 3/2000 | Ekkert et al. |
| 6,105,809 | A | 8/2000 | Yamanaka |
| 6,176,381 | B1 | 1/2001 | Mader |
| 6,776,302 | B2 | 8/2004 | Morris, Sr. |
| 6,926,165 | B2 | 8/2005 | Conti |
| 6,983,859 | B2 | 1/2006 | Azzarello |
| 7,513,384 | B2 | 4/2009 | Morris, Sr. |

* cited by examiner

PAIL WITH LOCKING LID

FIELD OF THE INVENTION

The present invention relates to a container having a locking lid, and more particularly to a lid with a locking mechanism connected to the lid possibly from a downwardly extending wall which cooperates with a stop which could be located above at least a portion of the threads on the container and/or engage with upward motion of the locking mechanism.

DESCRIPTION OF RELATED ART

The applicant and other companies have developed a number of locking lid pail constructions. Some of these locking lids include triggers or operators which release locking lids from a locked configuration. Mechanisms have been operably coupled to the pail such as provided in U.S. Pat. No. 7,513,384 incorporated in its entirety herein by reference. Others such as is shown in U.S. Pat. Nos. 6,776,302 and 5,147,060 have a locking mechanism operably coupled to the lid which engages one or more stops on the container. Some of the prior art lid with locking mechanisms have a locking lid mechanism which engages inwardly directed teeth from a container. At least U.S. Pat. No. 6,776,302 has outwardly directed teeth on the container. However, even with these improvements over other prior art constructions, there exists a need to be able to provide a more effective design for at least some particular uses.

SUMMARY OF THE INVENTION

Accordingly, it is the present object of the present invention to provide an improved container having a locking lid.

It is another object of at least some embodiments to provide an improved container with a lid with a locking mechanism retained in a side wall of the lid which engages a stop on the container possibly located above at least a portion of the threads.

It is another object of at least some embodiments of the present invention to provide an improved container with locking lid wherein the plurality of stops cooperate with the locking mechanism which receive an abutment of the locking mechanism moving upwardly from below with the stops preferably provided on an outer circumference of the pail.

It is an object of at least some embodiments of the present invention to provide a locking mechanism which connects to a lid provides a linearly actuated abutment which engages at least one stop while preferably being biased towards the stops.

Accordingly, in accordance with a presently preferred embodiment of the present invention, a container assembly can be provided comprising a lid and an open ended container. A locking mechanism is provided operably connected to the lid which cooperates with at least one stop connected to the container. The locking mechanism can be used to assist in retaining the lid on the container in a locking configuration, and by de-activating the locking mechanism allows the subsequent removal of the lid from the container. By moving the locking member to a disengaged configuration, the lid may be disengaged from the open ended container in some embodiments by twisting the lid relative to the container in an appropriate direction.

In a presently preferred embodiment of the present invention, the locking member can be operably connected to a downwardly depending side wall of the lid and may be provided in the form of a linearly operable slide which provides or is connected to an abutment. Stops, such as portions of teeth having angled surfaces directed towards stops, cooperate with an abutment of the locking mechanism particularly when the abutment is biased in a direction there against. The locking mechanism may then allow turning in one direction against the angled surfaces while preventing attempted turning of the abutment relative to a stop in the opposite direction when engaged with the abutment.

Locking member can preferably be disengaged by downwardly moving the slide wherein the abutment disengages the stop whereby allowing rotation in a direction previously prevented by the engagement of the abutment with the stop.

The teeth may preferably downwardly extending and can, for at least some embodiments, form a portion of the thread surface in some embodiments which can cooperate with at least some portion of the inwardly directed threads of the lid to facilitate the tightening of the lid relative to the container for teeth not engaging the abutment such as teeth opposite the locking mechanism about the container and/or others. When a locking member engages a stop, it can provide a locked configuration as would be understood by those of ordinary skill in the art and as described above.

Although the presently preferred embodiment includes a slide which may also an actuator which may be useful to remove the abutment from the stop, other embodiments may be constructed in other manners. Furthermore, the preferred embodiment may include a locking mechanism which is secured to the downwardly depending wall. Other embodiments may provide locking mechanisms connected to other portions of the lid. Finally, the stops may preferably be accessible to an abutment from below and may be engaged from an upwardly extending and moving abutment.

The teeth and/or stop(s) need not necessarily be provided to cooperate with the threads of the lid when not engaged in all embodiments, but this may be a useful feature for some embodiments. Finally, the stop(s) can be provided on one or more separate locations extending at or below the open end container, preferably above a rim and/or at least a portion of the threads for at least some embodiments and/or above a thread line of rotation of the threads on the container.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
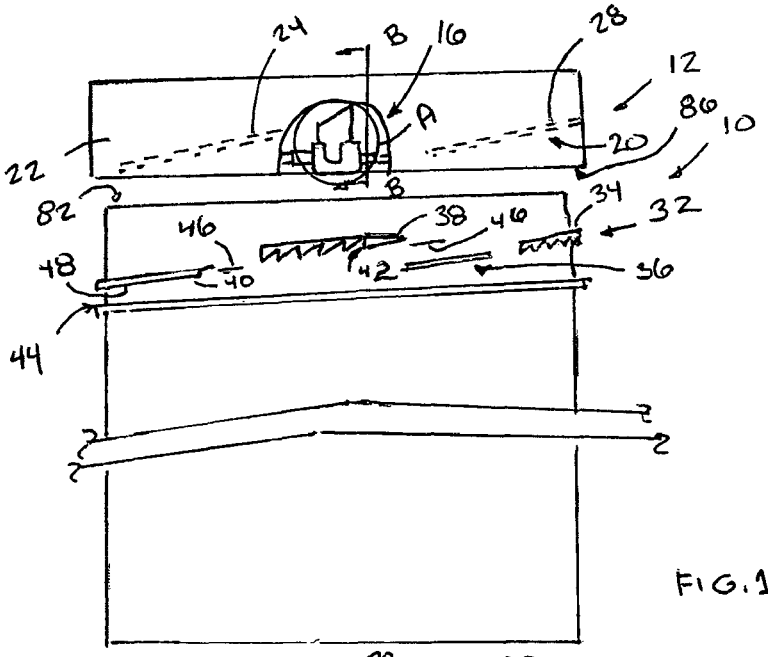
FIG. 1 shows a side plan view of a presently preferred embodiment of the present invention of an open ended container with lid in an open configuration with some internal portions of the lid shown in phantom.
Figure 2:
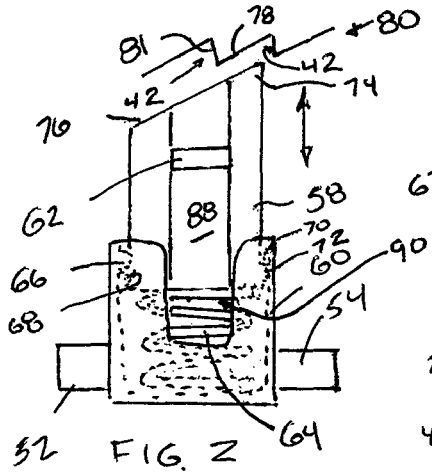
FIG. 2 shows detail portion A shown in FIG. 1 of the lid as it is about to engage a stop connected to the open ended container shown in FIG. 1.
Figure 3:
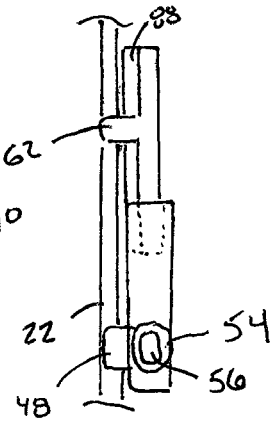
FIG. 3 is a cross-sectional view taken along the line of B-B of FIG. 1.

FIG. 1 shows a container assembly 10 comprising a lid 12 and open ended container 14. A locking mechanism 16 with a locking configuration is useful to resist the removal of lid 12 from the container 14 when the lid 12 has been connected to the container 14 in a fully closed configuration and locked configuration FIG. 1 shows the lid 12 removed from the container 14. Detail of the operation of the locking mechanism 16 may be understood with reference to FIGS. 2-3.

Figure 4:
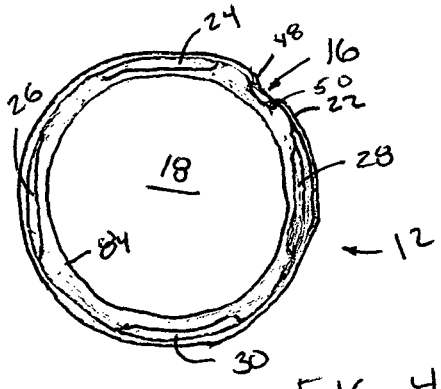
FIG. 4 is a bottom plan view of a bottom of the lid shown in FIG. 1.

As can be seen by FIG. 1 and FIG. 4, the lid 12 preferably provides a center portion 18 surrounded by a downwardly extending wall 22. The lid also preferably has inwardly directed threads 20 illustrated as thread portions 24,26,28,30 in FIG. 4. Fewer or more thread portions 24,26,28,30, or even a continuous thread, could be utilized in various embodiments. By utilizing thread portions 24,26,28,30, (or more or less) as illustrated one skilled in the art would recognize that various starting positions can be achieved with a container 14 having outwardly directed threads 32. In fact, a container 14 could also have thread portions 34,36,38, and/or 40 which cooperated with threads 20 such as thread portions 24,26,28,30 to initially contact and cooperate with thread portions 34 and 38 to then proceed on as rotated to contact thread portions 36 and 40 as would be understood by those of ordinary skill in the art. In this manner, no matter where the lid 12 is placed on top of the container 14, then the amount needed to turn the lid 12 to place it in a fully closed position can be normally significantly less than would be if a continuous threads 20 and/or 32 were utilized for various other embodiments. The applicant refers to this feature as interrupted threads and describes thread portions such as thread portions 24,26,28,30 and 34,36,38,40 throughout the application. The thread portions 38,40 and/or others could also provide a number of starting positions independently of starting positions provided by thread portions 24,26,28,30 as would be understood by those of ordinary skill in the art.

Fewer or more thread portions could be provided in either the lid 12 or the container 14. It would also be understood by those of ordinary skill in the art that the thread portions such as 34,36,38,40 extend around the opposite side of the container 10 shown in FIG. 1. Furthermore, all of the upper thread portions 34,38 need not necessarily provide stops 40 as illustrated and will be described in further detail below. Furthermore, other portions of stops 40 need not be integral to thread portions 34,38 as illustrated but instead may be disposed anywhere above a lip 44 and preferably above a thread rotation line such as thread line 46 which extends linearly off of a bottom surface 48 of threads such as thread portion 40 or elsewhere. Accordingly, as illustrated in FIG. 1, stop 40 is located at or above thread line 46 as will be explained in further detail below and below a top 82 of the container 14.

Locking mechanism 16 is shown connected to the downwardly extending wall 22 of the lid 12 as shown in FIGS. 1 and 4 such as with one or more arms 48,50 which may be molded and/or connected to the downwardly extending wall 22 as illustrated. Other connections for connecting the lid 12 and/or wall 22 to the locking mechanism 16 could be utilized with this and/or other embodiments. Connected to the arms 48,50 may be shoulders 52,54 which are illustrated as part of the locking mechanism 16. Other portions of the locking mechanism 16 could also and/or alternatively connect to the wall 22 and/or lid 12 in other embodiments. The shoulders 52,54, if utilized, may provide a socket 56 for receiving a portion of the arm 50 therein which could be understood by those of ordinary skill in the art as a connection. Accordingly, the locking mechanism 16 is directly connected to the downwardly extending wall 22. Other connection mechanisms may be provided to connect the locking mechanism 16 to the downwardly extending wall 22 and/or other portions of the lid 18 in various embodiments.

The locking mechanism 16 can provide a slide such as slide 58, if utilized, which can be partially received within housing 60 and is partially controlled by operator 62 which may allow for the linear displacement of slide 58 relative to the housing 60. The slide 58 may also be biased, if not linearly biased, in a position such as with spring 64 which preferentially directs abutment 74 to eventually engage one or more stops 42 as are provided on the container 14. Retainers which could be provided in the form of cooperating protrusions 66,68,70,72 from the slide 58 in the housing 60 provide one way of keeping the slide 58 in the housing 60. Some embodiments may not necessarily provide this feature at all or this way or it may be performed differently in different embodiments.

The stop(s) 42 are preferably engagable from below in many embodiments with preferably upwardly with a slide 58 with the abutment 74 then engaging at least one of a plurality of the stops 42. The lid 12 may be twisted in the counterclockwise direction which directs the first face 76 of the slide 58 to tend to be deflected by the angle face 78 of the teeth 80 so that when turning in the clockwise direction, the slide 58 does not prevent further tightening when rotating in that direction. Eventually the top 82 of the container could contact a bottom surface of lid 12 such as ridge 84 if utilized, the center 18 of the lid 12 or other structure. It is also possible for a bottom 86 of the lid 12 to contact the lip 44 to therefore potentially prevent further tightening. Other mechanisms could be utilized in other embodiments.

Slide 58 may be assisted in being retained and/or directed relative to the housing 60 such as by the provision of extended foot 88 which is received within slot 90 of the housing. Other features may or may not be utilized to facilitate such guidance of the slide 58 relative to the housing in various other embodiments.

At least one stop 42 may be provided such as a plurality of stops 42 provided such as in the form of teeth 80 providing vertical surfaces 81. The stop(s) 42 may also preferably be provided as a portion of and/or instead of a thread segment 38 in some embodiments. The stop(s) 42 may preferably also be located at or above the thread line 46 which is above the rim 44 and/or at least a portion of the threads 32 such as above a portion of thread segment 48 if not the entire thread segment 48 while being below the top 82.

As one can see from the figures and discussion, the lid 12 is preferably attached to the container 14 by rotating the lid 12 relative to the container 10 such as in a clockwise direction. The locking mechanism 16 then eventually engages one or more of the stops 42 and as long as continued rotation is employed. The locking mechanism 16 preferably does not prevent further rotation in that direction. However, when the rotation is halted, even if temporarily, and an opposite, such as counterclockwise rotation is attempted, the abutment 74 engages a stop 42 such as from below such as after moving in an upward direction, thereby providing a locked configuration until the user preferably moves the operator 62 downwardly a predetermined distance such as with the slide 58. The abutment 74 is thus downwardly disengaged from the stop 42 allowing the rotation in the counterclockwise direction to facilitate the loosening of the lid 12 of the container 12 and/or removal of the lid 10 relative to the container 14. Other locking mechanisms 16 may operate differently.

The applicant is unaware of any prior attempt to provide downwardly accessible stop(s) 42 as are provided in the illustrated embodiment. Furthermore, the applicant is unaware of any prior attempt to provide downwardly accessible stops 42 accessible by a linearly actuated abutment 74 of a locking mechanism. Furthermore, the applicant is also unaware of any prior attempt which provide an upwardly engaging locking member 16 connected to a lid 12 which engages a stop 42 from below on the container 14 particularly a linearly actuated locking mechanism 16. Furthermore, the applicant is unaware of any prior attempt to provide stops 42 above a lip 44 of a container 14 particularly above at least a portion of threads 48 such as above portion 48 and/or at or above thread line 46. In particular, the stops 42 may be located between the top 82 of the container 14 in the portion 40 or at least a portion thereof.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

The invention claimed is:

1. A container assembly comprising:

a container having an open end and outwardly directed threads extending from an outer exterior wall surface of the container, and at least one stop located between the open end and at least a portion of the threads;

a lid having a downwardly extending wall having inwardly directed threads configured to cooperate with the outwardly directed threads of the container to secure the lid relative to the container in a closed configuration;

and a locking mechanism connected to the downwardly extending wall of the lid, said locking mechanism having an abutment and an engaged and disengaged configuration, the abutment engaging at least one of the at least one stop in the engaged configuration and the abutment not engaging at least one of the at least one stop in the disengaged configuration; and an operator operably coupled to the abutment wherein movement of the operator a predetermined vertical distance moves the abutment to the disengaged configuration; and wherein the abutment is linearly biased against at least one of the at least one stop in the engaged configuration.

2. The container assembly of claim 1 wherein the container has interrupted outwardly directed threads providing thread segments.

3. The container assembly of claim 2 the threads provide a plurality of starting positions for engagement with threads on the lid.

4. The container assembly of claim 2 wherein the stop is connected to at least one of the thread segments.

5. The container assembly of claim 1 wherein the locking mechanism further comprises a slide at least assisting in coupling the abutment to the operator linear displacement of the slide with the operator transitions the locking mechanism from the engaged and disengaged configurations.

6. The container assembly of claim 1 wherein the abutment is upwardly biased against the at least one stop in the engaged configuration.

7. A container assembly comprising:

a container having an open end and outwardly directed threads extending from an outer exterior wall surface of the container, and at least one stop located between the open end and at least a portion of the threads;

a lid having a downwardly extending wall having inwardly directed threads configured to cooperate with the outwardly directed threads of the container to secure the lid relative to the container in a closed configuration;

and a locking mechanism connected to the downwardly extending wall of the lid, said locking mechanism having an abutment and an engaged and disengaged configuration, the abutment engaging at least one of the at least one stop in the engaged configuration and the abutment not engaging at least one of the at least one stop in the disengaged configuration; and an operator operably coupled to the abutment wherein movement of the operator a predetermined distance moves the abutment to the disengaged configuration; wherein the lid has interrupted threads providing thread segments and the locking mechanism is located between thread segments;

wherein the stop is a portion of a plurality of teeth each having an angled surface terminating at a vertical surface and the abutment contacts the vertical surface of one of the teeth in the engaged configuration.

8. The container assembly of claim 7 wherein the stop extends from the exterior surface of the container and is engaged by the abutment of the locking mechanism with the abutment moving in an upward direction from below the stop from the disengaged configuration.

9. The container assembly of claim 7 wherein the teeth terminate at or above a thread pitch of the threads.

10. The container assembly of claim 9 wherein at least some teeth not engaging the abutment cooperate with at least some of the threads of the lid to assist in retaining the lid to the container when connected.

11. A container assembly comprising:

a container having an open end and outwardly directed threads extending from an outer exterior wall surface of the container, and at least one stop extending from the outer exterior wall surface of the container;

a lid having a downwardly extending wall having inwardly directed threads configured to cooperate with the outwardly directed threads of the container to secure the lid relative to the container in a closed configuration;

and a locking mechanism operably coupled to the lid, said locking mechanism having an abutment and an engaged and disengaged configuration, the abutment engaging at least one of the at least one stop after moving in an upward direction in the engaged configuration from below and the abutment not engaging at least one of the at least one stop in the disengaged configuration, with the abutment upwardly biased into the engaged configuration; and an operator operably coupled to the abutment wherein movement of the operator a predetermined distance moves the abutment to the disengaged configuration.

12. The container assembly of claim 11 wherein the locking mechanism is connected to the downwardly extending wall of the lid.

13. The container assembly of claim 12 wherein the threads of the lid are interrupted thread segments and the locking mechanism is located between thread segments on the downwardly extending wall of the lid.

14. A container assembly comprising:

a container having an open end and outwardly directed threads extending from an outer exterior wall surface of the container, and at least one stop extending from the outer exterior wall surface of the container;

a lid having a downwardly extending wall having inwardly directed threads configured to cooperate with the outwardly directed threads of the container to secure the lid relative to the container in a closed configuration;

and a locking mechanism operably coupled to the lid, said locking mechanism having an abutment and an engaged and disengaged configuration, the abutment engaging at least one of the at least one stop after moving in an upward direction in the engaged configuration from below and the abutment not engaging at least one of the at least one stop in the disengaged configuration; and an operator operably coupled to the abutment wherein movement of the operator a predetermined distance moves the abutment to the disengaged configuration;

wherein the at least one stop is a portion of a plurality of teeth each having an angled surface terminating at a vertical surface and the abutment contacts the vertical surface of one of the teeth in the engaged configuration.

15. The container assembly of claim 14 wherein the teeth terminate at or above a thread pitch of the threads.

16. The container assembly of claim 15 wherein at least some teeth not engaging the abutment cooperate with at least some of the threads of the lid to assist in retaining the lid to the container when connected.

17. A container assembly comprising:

a container having an open end and outwardly directed threads extending from an outer exterior wall surface of the container, and a stop;

a lid having a downwardly extending wall having inwardly directed threads configured to cooperate with the outwardly directed threads of the container to secure the lid relative to the container in a closed configuration;

and a locking mechanism operably coupled to the lid, said locking mechanism having an abutment and an engaged and disengaged configuration, the abutment engaging the stop in the engaged configuration as biased upwardly from below, the stop and the abutment not engaging the stop by being moved downwardly to the disengaged configuration; and an operator operably coupled to the abutment wherein movement of the operator a predetermined distance moves the abutment to the disengaged configuration.

18. The container assembly of claim 17 wherein the locking mechanism is connected to the downwardly extending wall of the lid and the stop is connected to at least a portion of the threads on the container.

19. A container assembly comprising:

a container having an open end and outwardly directed threads extending from an outer exterior wall surface of the container, and a stop;

a lid having a downwardly extending wall having inwardly directed threads configured to cooperate with the outwardly directed threads of the container to secure the lid relative to the container in a closed configuration;

and a locking mechanism operably coupled to the lid, said locking mechanism having an abutment and an engaged and disengaged configuration, the abutment engaging the stop in the engaged configuration from below, the stop and the abutment not engaging the stop by being moved downwardly to the disengaged configuration; and an operator operably coupled to the abutment wherein movement of the operator a predetermined distance moves the abutment to the disengaged configuration; wherein the stop is a portion a portion of a plurality of teeth and at least some of the teeth which are not engaging the abutment cooperate with at least some of the threads of the lid to assist in retaining the lid to the container when connected.

* * * * *